US006340303B2

(12) United States Patent
Hamada et al.

(10) Patent No.: US 6,340,303 B2
(45) **Date of Patent: *Jan. 22, 2002**

(54) HIGH TENSION CONNECTION PORTION STRUCTURE OF AN INGITION DEVICE FOR AN INTERNAL COMBUSTION ENGINE

(75) Inventors: Kazuya Hamada; Shingo Morita; Shigemi Murata; Mitsuru Koiwa, all of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/496,335

(22) Filed: Feb. 2, 2000

(30) Foreign Application Priority Data

Sep. 19, 1999 (JP) ..... 11-261626

(51) Int. Cl.[7] ..... H01R 13/44; H01R 13/502; H01R 13/514; H01R 13/24; H01R 13/627

(52) U.S. Cl. ..... 439/127; 439/701; 439/824; 439/349

(58) Field of Search ..... 439/125, 127, 439/701, 824, 846, 349

(56) References Cited

U.S. PATENT DOCUMENTS 5,630,722 A * 5/1997 Mochizuki et al. ..... 439/125
5,632,636 A * 5/1997 Maekawa ..... 439/125
5,682,865 A * 11/1997 Maekawa et al. ..... 123/635
5,685,282 A * 11/1997 Murata et al. ..... 123/635
5,716,223 A * 2/1998 Phillips, Jr. et al. ..... 439/125
5,749,742 A * 5/1998 Bertuzzi, Jr. et al. ..... 439/125
5,827,079 A * 10/1998 Murata ..... 439/125
5,957,706 A * 9/1999 Phillips, Jr. et al. ..... 439/127
6,068,495 A * 5/2000 Virchow ..... 439/125
6,104,205 A * 8/2000 Mawby ..... 324/761

FOREIGN PATENT DOCUMENTS

JP 6-68381 9/1994 ..... H01T/13/04

* cited by examiner

*Primary Examiner*—Tho D. Ta
*Assistant Examiner*—Edwin A. León
(74) *Attorney, Agent, or Firm*—Sughrue Mion, PLLC

(57) ABSTRACT

To provide a high tension connection portion structure for an ignition device for an internal combustion engine, which may prevent an instantaneous breakdown of the connection even if an external force is applied to a high tension connection portion, may enhance a connection property of the high tension connection portion by suppressing a sliding movement between metal terminals of the connection portion and may be applied to the path of a minute current such as an ionic current or the like, a connecting structure of a high tension connection portion used in an ignition device for an internal combustion engine, includes: a first high tension connection terminal 2; a second high tension connection terminal 4 for electrically connecting with the first high tension connection terminal 2; a locking mechanism 2*a* provided between the first high tension connection terminal 2 and the second high tension connection terminal 4 for restricting the separation therebetween in the axial direction; and a spring member 7 disposed between the first high tension connection terminal 2 and the second high tension connection terminal 4.

9 Claims, 7 Drawing Sheets

HIGH TENSION CONNECTION PORTION STRUCTURE OF AN INGITION DEVICE FOR AN INTERNAL COMBUSTION ENGINE

BACKGROUND OF THE INVENTION

1. Field of the Invention

The present invention relates to a connecting structure of a high tension connection portion of an ignition device for an internal combustion engine.

2. Description of the Related Art

FIG. 8 is a side elevational view having a partial cross section showing a conventional connecting structure of a high tension connection portion. In FIG. 8, a high tension cable 3 is provided between an ignition plug 4 and an ignition coil (not shown) to electrically connect the two components with each other.

An ignition plug cap 1 is provided on the side of the ignition plug 4 of the high tension cable 3. The ignition plug cap 1 has a cap 1*a* made of rubber and a high tension connection terminal 2 formed into a cylindrical shape made of metal and embedded inside the cap 1*a*. An ignition plug fixture member 2*a* is provided on the connection side of the ignition plug 4 of the high tension connection terminal 2. Also, the other side of the high tension connection terminal 2 is press-fitted to the high tension cable 3.

The ignition plug fixture member 2*a* is formed as follows. Namely, first of all, round holes are formed at two diametrically opposite positions of the cylinder of the high tension connection terminal 2. A C-shaped member formed by curving an elongated steel plate in the longitudinal direction so as to cover these round holes. Projections directed inwardly toward both end portions corresponding to the round holes at the two positions of the high tension connection terminal 2 are formed on the C-shaped member. These projections are formed with top portions projecting inwardly of the high tension connection terminal 2 from the round holes. The C-shaped member has a hard elasticity and the projections are retractable from the round holes.

A head portion of the ignition plug 4 is inserted and engaged to the ignition plug fixture member 2*a*. If the ignition plug 4 is inserted in the axial direction with a predetermined force, the ignition plug is click-engaged with the ignition plug fixture member 2*a*. Also, if the ignition plug is drawn out with a predetermined force, it is removed away from the ignition plug fixture member 2*a*.

On the other hand, a high tension boot 6 is provided on the side of the ignition coil of the high tension cable 3. The high tension boot 6 has a cap 6*a* made of rubber substantially in the form of a cylinder and a connection terminal 6*b* made of metal provided to project toward a center of the cap 6*a*.

A high tension tower 5 is provided to the ignition coil (not shown). The high tension tower 5 has a sleeve portion 5*a* made of resin substantially in the form of a cylinder and a connection terminal 5*b* made of metal with a U-shaped cross-section and embedded in an inner surface and a bottom surface of the sleeve portion 5*a*.

The sleeve portion 5*a* of the high tension tower 5 is inserted and engaged between the cap 6*a* of the high tension boot 6 and the connection terminal 6*b* . The connection terminal 5*b* of the high tension tower 5 is connected so as to cover the connection terminal 6*b* of the high tension boot 6.

The thus constructed high tension cable 3 electrically connects the ignition plug 4 and the ignition coil (not shown) with each other, and applies to the ignition plug 4 an ignition voltage generated in the ignition coil to thereby ignite the mixture within a cylinder of the internal combustion engine.

Conventionally, in general, it is known that if fuel is burnt within a cylinder of the internal combustion engine, an ion is generated. Then, if a probe to which a predetermined voltage is applied is provided within the cylinder, it is possible to observe the ion as an ionic current. Also, if a knock is generated within the internal combustion engine, a knock vibratory component is superimposed on the ionic current. It is therefore possible to detect the generation of the knock by extracting the vibratory component.

Recently, the device is proposed in which the ignition plug 4 is used as a probe for the detection of the ionic current, and a judgement of absence/presence of the knock is performed on the basis of the amount of the ionic current to be detected immediately after the ignition.

In the connecting structure of the high tension connection portion shown in FIG. 8, the ignition plug fixture member 2*a* of the high tension connection terminal 2 has a function to fix the head portion of the ignition plug 4 in place. However, a small clearance is present between the ignition plug fixture member 2*a* and the ignition plug 4. In the case where the ignition plug 4 is used for the normal purpose of ignition, the ignition voltage is in the range of about several kV to several tens of kV. Accordingly, even if there is a small clearance therebetween, there is no problem because the conduction may be taken due to the insulation fracture.

However, in the case where the minute ionic current is detected for the above-described purpose, even the slight clearance would affect significantly as the resistance. In particular, when an external force works to the connection portion, there is a fear that an instantaneous wire brake condition would be generated. Due to this problem, there is a problem in that the ionic current is not correctly detected.

On the other hand, on the side of the ignition coil side, the connection terminal 5*b* of the high tension tower 5 and the connection terminal 6*b* of the high tension boot 6 are connected to each other only with a frictional resistance. In the case where an external force is applied thereto, a minute sliding movement is generated at the connection portion. Then, due to the minute sliding movement, there is a problem in that an insulation coating film such as an oxygen film or the like would be formed between the two components.

Furthermore, in the same manner as in the ignition plug cap 1, due to an external force, there is a fear that the instantaneous wire break condition would be generated in the connection portion between the connection terminal 5*b* and the connection terminal 6*b*. Thus, it is impossible to use the conventional structure as the path for the ionic current.

SUMMARY OF THE INVENTION

The present invention has been made in order to overcome the above-described shortcoming, and therefore has an object to provide a high tension connection portion structure for an ignition device for an internal combustion engine, which may prevent an instantaneous breakdown even if an external force is applied to a high tension connection portion, may enhance a connection property of the connection portion by suppressing a sliding movement between metal terminals of the connection portion and may be applied to a path of a minute current such as an ionic current or the like.

In order to achieve the above object, according to one aspect of the present invention, there is provided a high tension connection portion structure of an ignition device for an internal combustion engine, comprises a first high tension connection terminal; a second high tension connection terminal for electrically connecting with the first high tension connection terminal; a lock structure provided between the first high tension connection terminal and the second high tension connection terminal for restricting the separation therebetween; and a spring member disposed between the first high tension connection terminal and the second high tension connection terminal.

According to another aspect of the present invention, there is provided the high tension connection portion structure of an ignition device for an internal combustion engine, wherein the first high tension connection terminal has an outer electrode having a recess type engagement portion into which the second high tension connection terminal is to be inserted, and the spring member is disposed inside of the recess type engagement portion between the recess type engagement portion and the second high tension connection terminal.

According to still another aspect of the present invention, there is provided the high tension connection portion structure of an ignition device for an internal combustion engine, wherein the spring member is enlarged so that a diameter of a part thereof is substantially equal to an inner diameter of the outer electrode.

According to a further aspect of the present invention, there is provided the high tension connection portion structure of an ignition device for an internal combustion engine, wherein an end portion of the spring member holds at least one of the first high tension connection terminal and the second high tension connection terminal.

According to a still further aspect of the present invention, there is provided the high tension connection portion structure of an ignition device for an internal combustion engine, wherein the recess type engagement portion has a cylindrical portion, and the second high tension connection terminal has an insulating retainer portion for holding an outer circumferential portion of the cylindrical portion.

DESCRIPTION OF THE PREFERRED EMBODIMENTS

Embodiment 1

Figure 1:
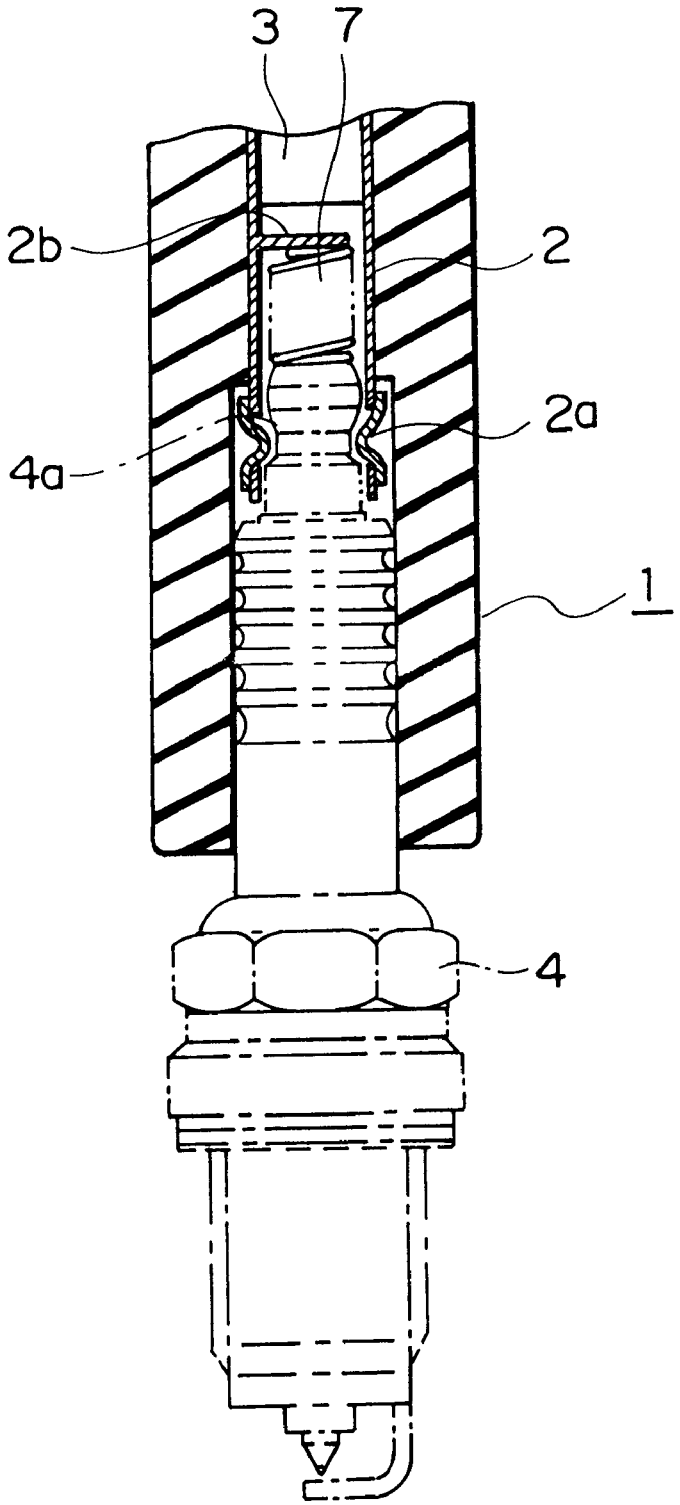
FIG. 1 is a cross-sectional view showing the connecting structure of a connection portion on the side of an ignition plug of a high tension connection portion structure of an ignition device for an internal combustion engine according to the present invention.

FIG. 1 is a cross-sectional view showing the connecting structure of a connection portion on the side of an ignition plug of a high tension connection portion structure of an ignition device for an internal combustion engine according to the present invention. In the same manner as in the conventional case, an ignition plug fixture member 2*a* is provided on the connection side of an ignition plug 4 of a high tension connection terminal 2 made of metal in the form of a cylinder as a first high tension connection terminal. A head portion of the ignition plug 4 that is a second high tension connection terminal is inserted and engaged with the ignition plug fixture member 2*a*. An engagement groove 4*a* is formed over the entire circumference of the head portion of the ignition plug 4. The engagement groove 4*a* engages with the ignition plug fixture member 2*a* and restricts a position in the axial direction of the ignition plug 4. The ignition plug fixture member 2*a* and the engagement groove 4*a* constitute a lock structure for. restricting separation in the axial direction. Also, the high tension connection terminal 2 constitutes an outer electrode having a recess type engagement portion.

A spring member 7 is provided in the high tension connection terminal 2 in this embodiment. A spring member retainer portion 2*b* is formed in an upright condition on an inner wall of the high tension connection terminal 2. The spring member 7 is received to be contained between the spring member retainer portion 2*b* and the ignition plug 4.

The spring member retainer portion 2*b* has a function to cause an interval between the head portion of the ignition plug 4 and the spring member retainer portion 2*b* to be a predetermined interval. A predetermined pre-pressure may be imparted to the ignition plug 4 because the spring member 7 having a predetermined length is pressed and contained in the predetermined interval. For this reason, for instance, even if the press-bond position of the high tension connection terminal 2 to a high tension cable 3 is changed slightly, the interval between the head portion of the ignition plug 4 and the spring member retainer portion 2*b* is unchanged to thereby obtain a predetermined pre-pressure all the time.

In the thus constructed connecting structure of the high tension connection portion, since the spring member 7 imparts a pre-pressure to a top surface of the head portion of the ignition plug 4 to press the electrode portion of the ignition plug 4 to the ignition plug fixture member 2*a*, the electrical connection is ensured to enhance the reliability. For this reason, even if an external force is applied to the high tension connection portion, it is possible to prevent an instantaneous breakdown of the connection, and also to apply this structure to the path of a minute current such as an ionic current or the like.

Embodiment 2

Figure 2:
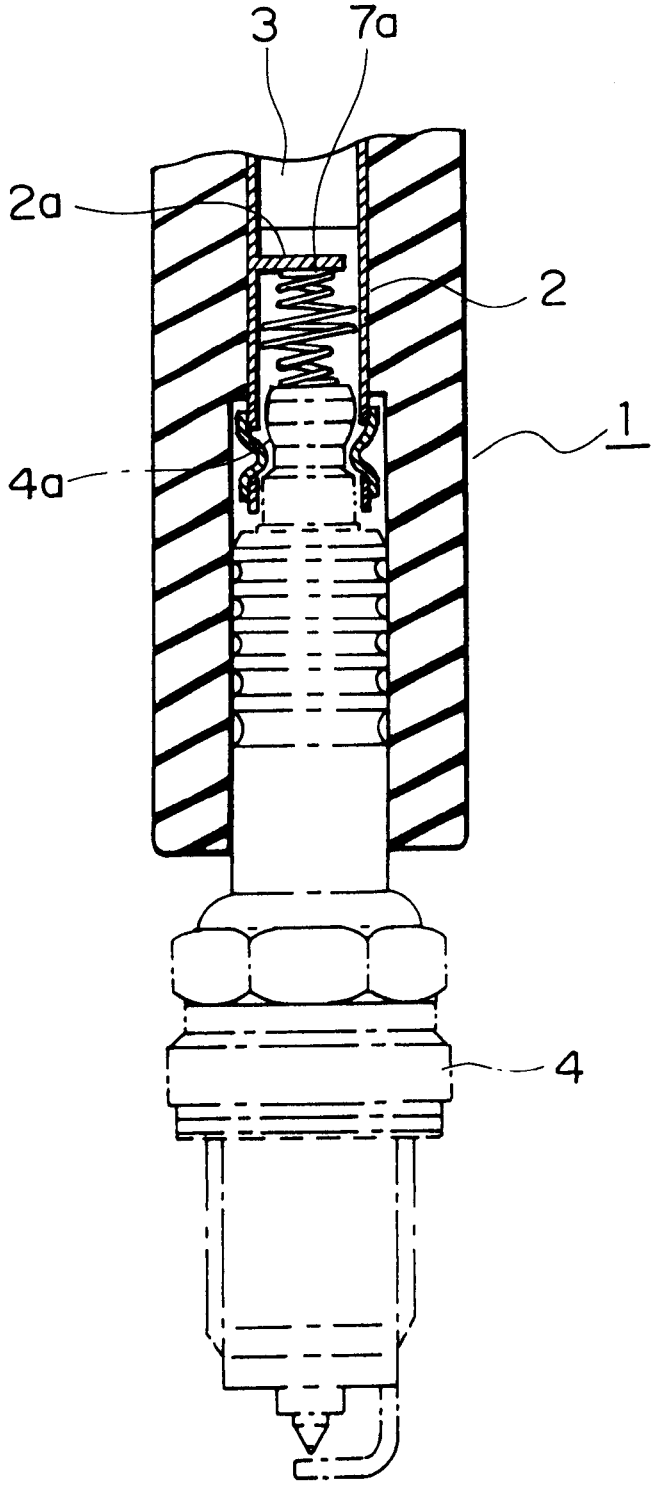
FIG. 2 is a cross-sectional view showing another example of the connecting structure of a connection portion on the side of an ignition plug of a high tension connection portion structure of an ignition device for an internal combustion engine according to the present invention.

FIG. 2 is a cross-sectional view showing another example of the connecting structure of a connection portion on the side of an ignition plug of a high tension connection portion structure of an ignition device for an internal combustion engine according to the present invention. In this embodiment, a spring member 7*a* disposed within the high tension connection terminal 2 is formed to have substantially the same diameter of a part of a central portion as the inner diameter of the high tension connection terminal 2. Actually, the inner diameter of the high tension connection terminal 2 is 7 mm, whereas the portion where the diameter of the spring member 7*a* is increased, is 6.4 mm in diameter.

In the thus constructed connecting structure of the high tension connection portion, since the radial movement of the spring member 7 within the high tension connection terminal 2 is restricted and the tilt of the spring member 7 may be prevented. For this reason, the electrical connection is further ensured, and the structure may be used more suitably for the path of a minute current such as an ionic current or the like.

Embodiment 3

Figure 3:
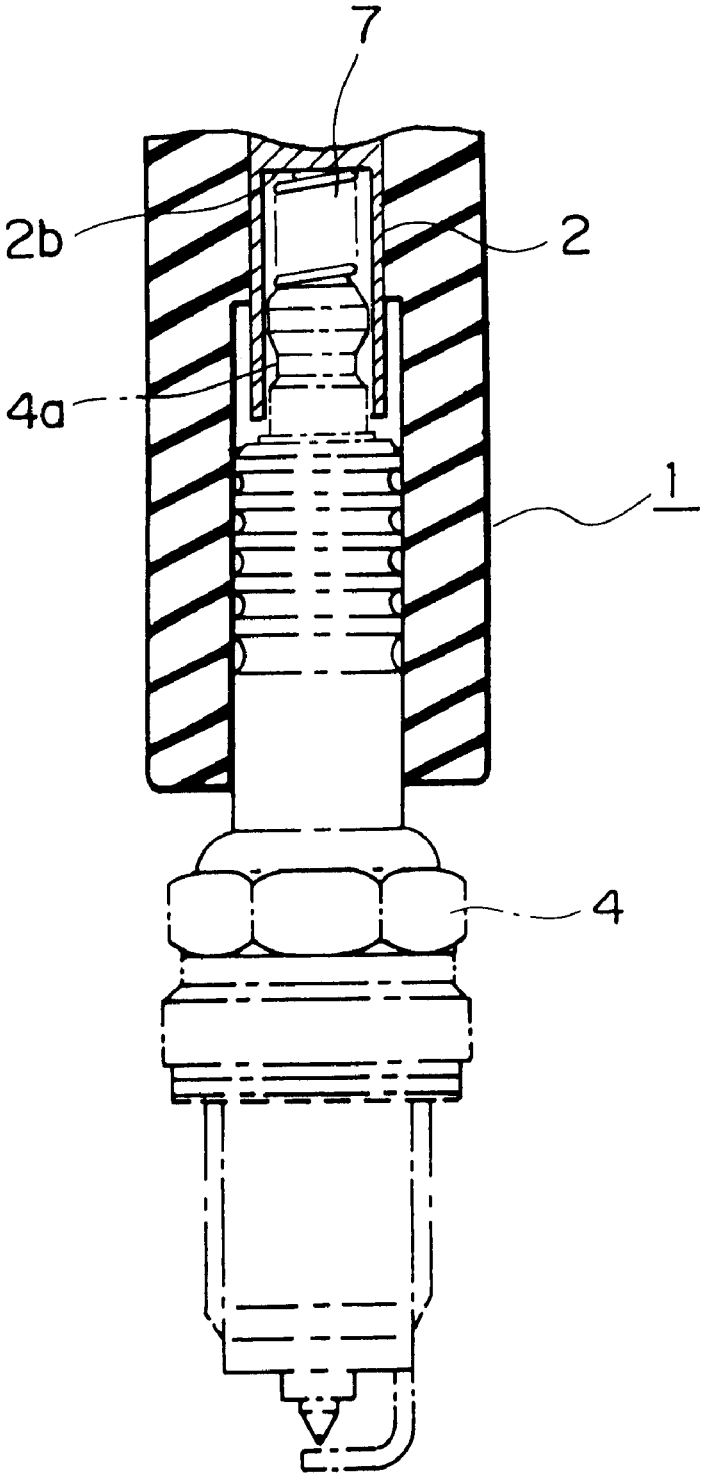
FIG. 3 is a cross-sectional view showing still another example of the connecting structure of a connection portion on the side of an ignition plug of a high tension connection portion structure of an ignition device for an internal combustion engine according to the present invention.
Figure 4:
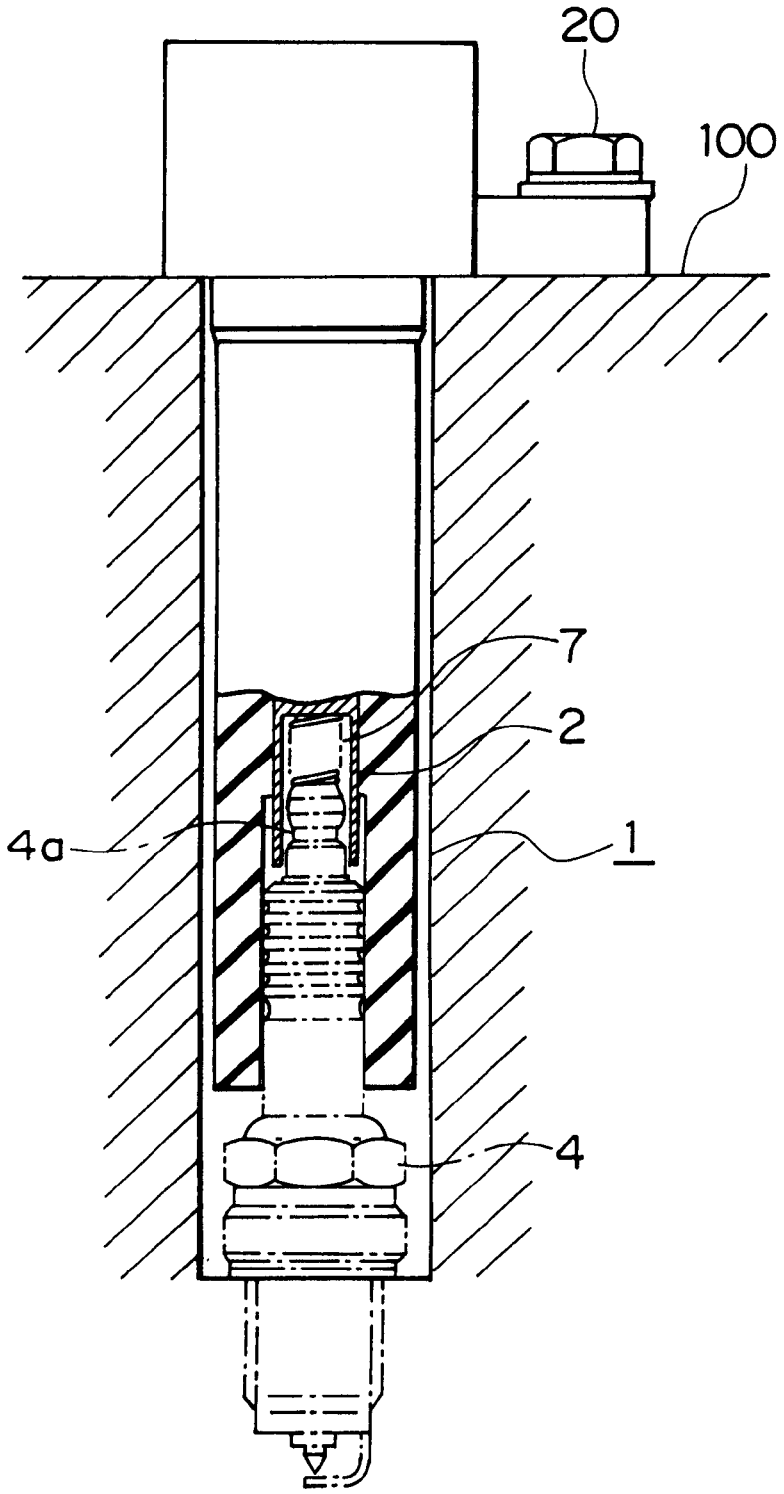
FIG. 4 is a partially fragmentary side elevational view showing a state in which an ignition plug cap is mounted on the internal combustion engine.

FIG. 3 is a cross-sectional view showing still another example of the connecting structure of a connection portion on the side of an ignition plug of a high tension connection portion structure of an ignition device for an internal combustion engine according to the present invention. Also, FIG. 4 is a partially fragmentary side elevational view showing a state in which an ignition plug cap is mounted on the internal combustion engine. In comparison with the first embodiment, the ignition plug fixture member 2*a* is not provided in the high tension connection terminal 2 according to this embodiment. Then, the ignition plug cap 1 is fixed to the mounting portion of an internal combustion engine 100 by a bolt 20 which constitutes a lock structure.

In the thus constructed connecting structure of the high tension connection portion, since the electrode portion of the ignition plug 4 may be slightly moved in the axial direction within the high tension connection terminal 2, it is possible to reduce a stress that is applied to the fixture portion (i.e., bolt 20) of the ignition plug cap 1 while ensuring the electrical connection.

Note that, in some cases, the portions that project in a flanged shape for the purpose of mounting the ignition plug cap 1 by the bolt 20 are used as discrete members from the ignition plug cap 1.

Embodiment 4

Figure 5:
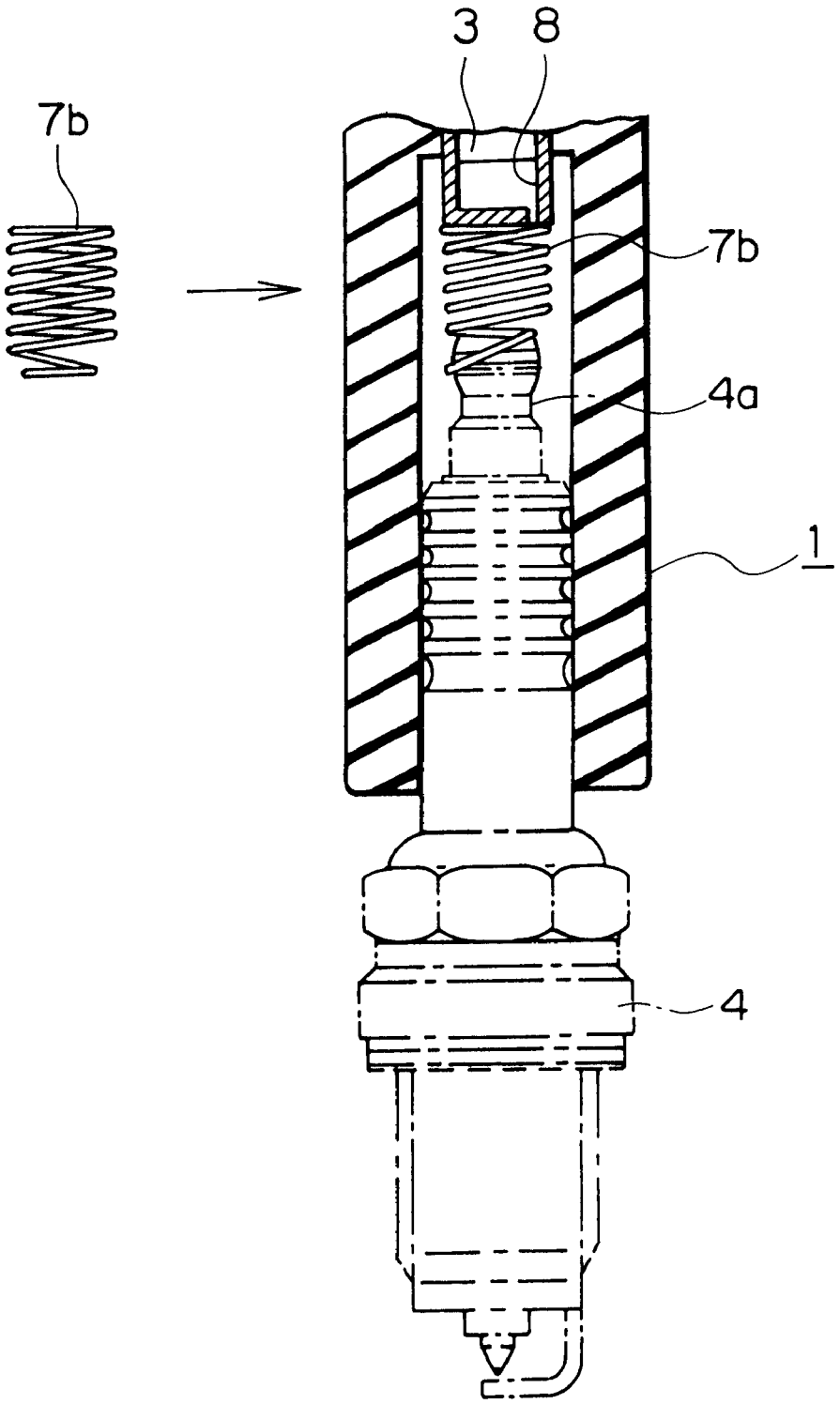
FIG. 5 is a cross-sectional view showing still another example of the connecting structure of a connection portion on the side of an ignition plug of a high tension connection portion structure of an ignition device for an internal combustion engine according to the present invention.

FIG. 5 is a cross-sectional view showing still another example of the connecting structure of a connection portion on the side of an ignition plug of a high tension connection portion structure of an ignition device for an internal combustion engine according to the present invention. In this embodiment, one turn layer on the side of the ignition plug 4 of the spring member 7*b* is smaller than the other portion and is formed to have a diameter such that the head portion of the ignition plug 4 is surrounded thereby. More specifically, the one turn layer on the side of the ignition plug 4 of the spring member 7*b* is formed to be slightly smaller than that of the head portion of the ignition plug 4.

When the ignition plug 4 is inserted and engaged, the one turn layer on the side of the ignition plug 4 of the spring member 7*b* is shrunken so as to embrace the head portion of the ignition plug 4 in accordance with the invasion of the ignition plug 4 and to be brought into contact with the head portion of the ignition plug 4 to hold the head portion.

In the thus constructed connecting structure of the high tension connection portion, the connection portion formed in the form of a cylinder in a high tension terminal 8 may be dispensed with. Then, since the followability of the spring member 7*b* is improved and the contactability is improved, the electrical connection may be further ensured. For this reason, the structure further improves the application to the path of a minute current such as an ionic current or the like.

Embodiment 5

Figure 6:
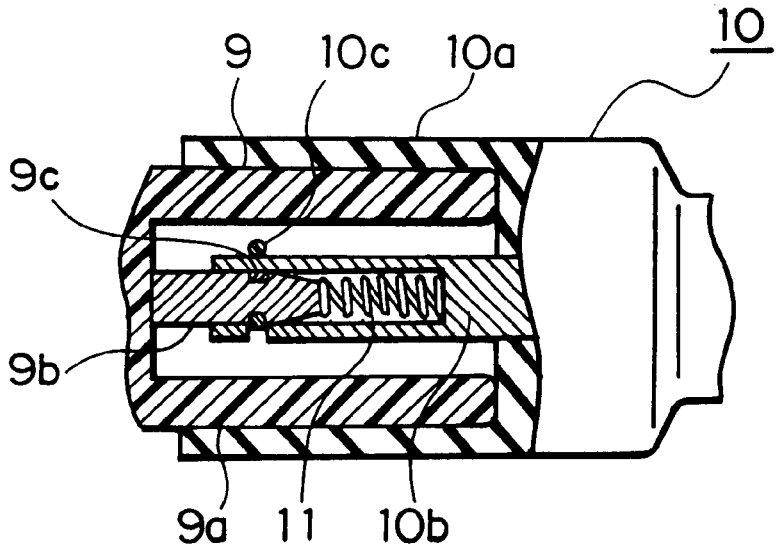
FIG. 6 is a cross-sectional view showing still another example of the connecting structure of a connection portion on the side of an ignition coil of a high tension connection portion structure of an ignition device for an internal combustion engine according to the present invention.

FIG. 6 is a cross-sectional view showing still another example of the connecting structure of a connection portion on the side of an ignition coil of a high tension connection portion structure of an ignition device for an internal combustion engine according to the present invention. In FIG. 6, a high tension boot 10 is provided on the side of the ignition coil (not shown) of the high tension cable. The high tension boot 10 has a cap 10*a* made of rubber substantially in the form of a cylinder and a connection terminal 10*b* made of metal as a first high tension connection terminal provided projectingly from a center of the cap 10*a*.

The connection terminal 10*b* is in the form of a bottomed cylinder and provided at its tip end with an engagement ring 10*c* that is substantially in a D-shape. A slit is formed which extends by a predetermined length in the circumferential direction at a predetermined position of the tip end of the connection terminal 10*b*. The engagement ring 10*c* is disposed around the position where the slit is formed. Then, a linear portion of the D-shape of the engagement ring 10*c* projects into the cylinder from the slit. The engagement ring 10*c* has a hard elasticity and is retractable from the slit by the removal/insert of a connection terminal 9*b*. A spring member 11 is provided in the connection terminal 10*b*.

On the other hand, a high tension tower 9 is provided to the ignition coil (not shown). The high tension tower 9 has a substantially cylindrical sleeve portion 9*a* made of resin and the connection terminal 9*b* made of metal and provided projectingly from a center of the sleeve portion 9*a* as a second high tension connection terminal. An engagement groove 9*c* formed over the entire circumference is provided at a tip end portion of the connection terminal 9*b*.

The sleeve portion 9*a* of the high tension tower 9 is inserted into the cap 10*a* of the high tension boot 10. At this time, the connection terminal 9*b* is inserted and bonded to the connection terminal 10*b*. Then, the engagement ring 10*c* and the engagement groove 9*c* are engaged with each other. The connection terminal 9*b* is pressingly inserted in the axial direction with a predetermined force and is click-engaged with the engagement ring 10*c*. Also, if the connection terminal 9*b* is drawn out with a predetermined force, it may be removed away from the engagement ring 10*c*. The engagement ring 10*c* and the engagement groove 9*c* constitute a lock structure for restricting the separation in the axial direction.

In the thus constructed high tension connection portion structure, the spring member 11 imparts a pre-pressure to the tip end of the connection terminal 9*b* so that the lock structure is biased on one side to thereby ensure the electrical connection. For this reason, even if an external force is applied thereto, there is no fear that a sliding movement occurs in the connection portion. As a result, there is no fear that an insulating coating film such as an oxygen film is formed. This is also good as the path of a minute current such as an ionic current or the like.

Embodiment 6

Figure 7:
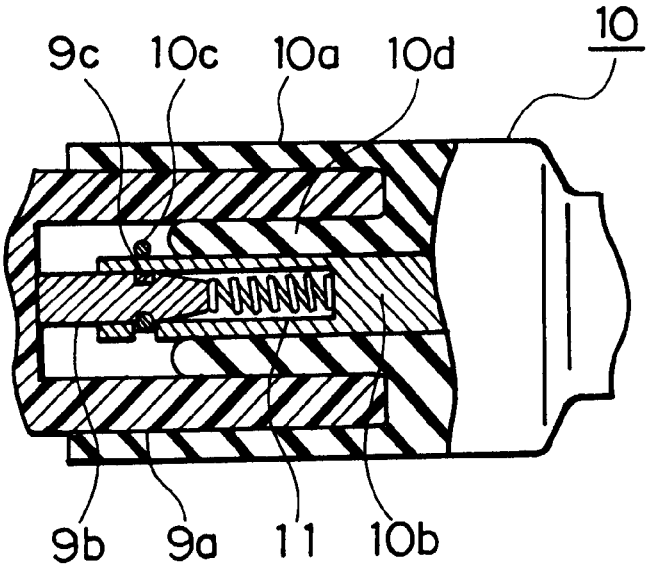
FIG. 7 is a cross-sectional view showing still another example of the connecting structure of a connection portion on the side of an ignition coil of a high tension connection portion structure of an ignition device for an internal combustion engine according to the present invention.
Figure 8:
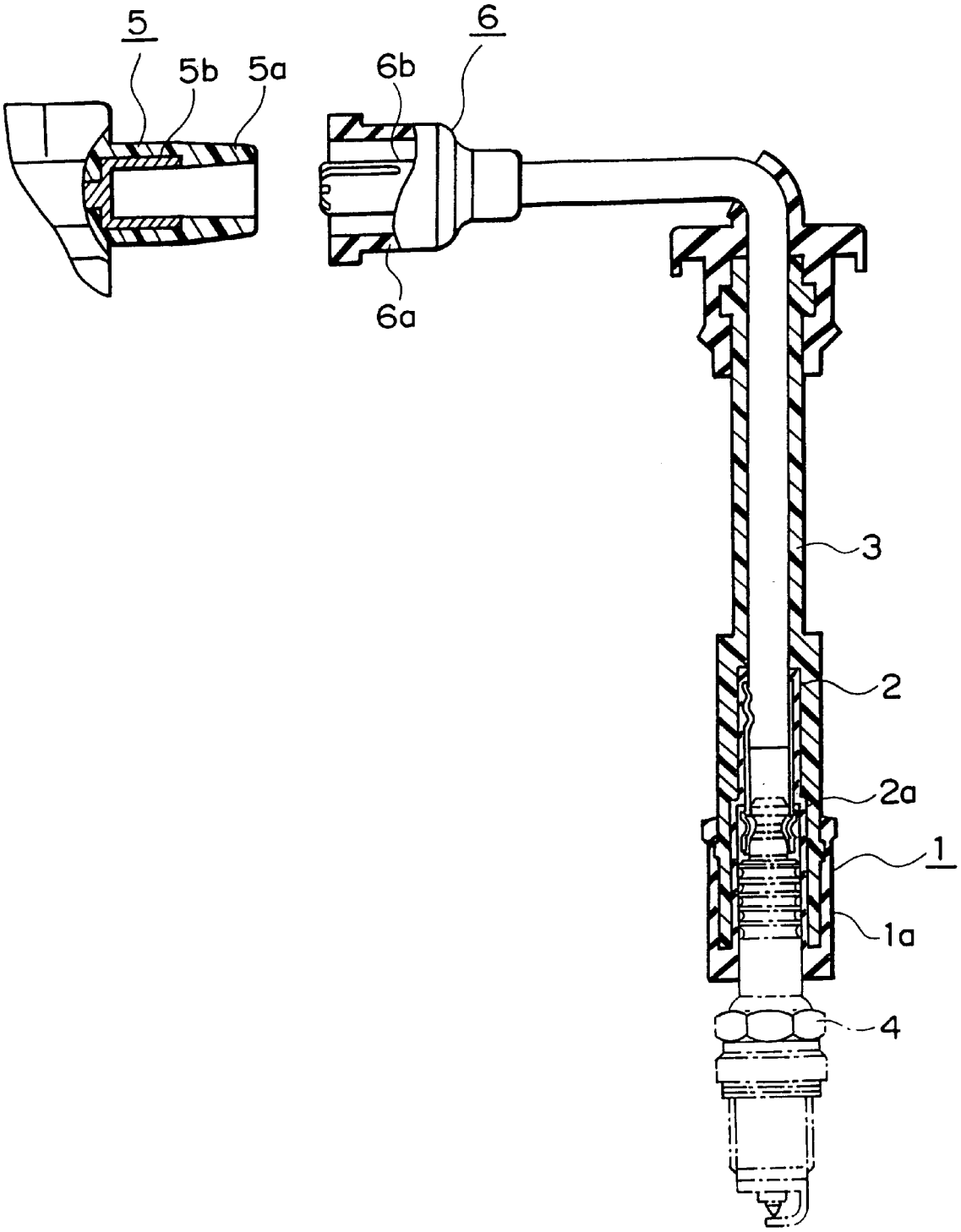
FIG. 8 is a side elevational view having a partial cross-section showing a conventional connecting structure of the high tension connection portion.

FIG. 7 is a cross-sectional view showing still another example of the connecting structure of a connection portion on the side of an ignition coil of a high tension connection portion structure of an ignition device for an internal combustion engine according to the present invention. In this embodiment, the high tension boot 10 has a rubber made retainer portion 10*d* to be inserted between the sleeve portion 9*a* of the high tension tower 9 and the connection terminal 10*b*. The retainer portion 10*d* holds the connection terminal 10*b* with its outer surface in intimate contact with the sleeve portion 9*a* and with its inner surface in intimate contact with the connection terminal 10*b*. The other structure is the same as that of the foregoing embodiment.

In the thus constructed high tension connecting portion structure, the retainer portion 10*d* suppresses the movement of the connection terminal 10*b* in the radial direction. For this reason, the electrical connection is further ensured. This is also better as the path of a minute current such as an ionic current.

According to one aspect of the present invention, there is provided a high tension connection portion structure of an ignition device for an internal combustion engine, comprises a first high tension connection terminal; a second high tension connection terminal for electrically connecting with the first high tension connection terminal; a lock structure provided between the first high tension connection terminal and the second high tension connection terminal for restricting the separation therebetween; and a spring member disposed between the first high tension connection terminal and the second high tension connection terminal. For this reason, the spring member imparts a pre-pressure in the axial direction to thereby ensure the electrical connection between the first high tension connection terminal and the second high tension connection terminal. As a result, even if an external force is applied to the high tension connection portion, it is possible to prevent an instantaneous breakdown of the connection and also to use the structure as the path for a minute current such as an ionic current or the like.

According to another aspect of the present invention, there is provided the high tension connection portion structure of an ignition device for an internal combustion engine, wherein the first high tension connection terminal has an outer electrode having a recess type engagement portion into which the second high tension connection terminal is to be inserted, and the spring member is disposed inside of the recess type engagement portion between the recess type engagement portion and the second high tension connection terminal. For this reason, the spring member is arranged inside of the recess type engagement portion and may be received therein without fail. There is no fear that the spring member is projected out. Accordingly, it is possible to further prevent the instantaneous breakdown of the connection. The structure may be further suitably used as the path for a minute current such as an ionic current or the like.

According to still another aspect of the present invention, there is provided the high tension connection portion structure of an ignition device for an internal combustion engine, wherein the spring member is enlarged so that a diameter of a part thereof is substantially equal to an inner diameter of the outer electrode. For this reason, the radial movement of the spring member is restricted and the tilt of the spring member is prevented. Accordingly, it is possible to further ensure the electrical connection. The structure may be further suitably used as the path for a minute current such as an ionic current or the like.

According to a further aspect of the present invention, there is provided the high tension connection portion structure of an ignition device for an internal combustion engine, wherein an end portion of the spring member holds at least one of the first high tension connection terminal and the second high tension connection terminal. For this reason, the followability of the spring member is better and the contactability is further improved. Thus, the electrical connection is further improved. For this reason, the structure may be further suitably used as the path for a minute current such as an ionic current or the like.

According to a still further aspect of the present invention, there is provided the high tension connection portion structure of an ignition device for an internal combustion engine, wherein the recess type engagement portion has a cylindrical portion, and the first high tension connection terminal has an insulating retainer portion for holding an outer circumferential portion of the cylindrical portion. For this reason,the retainer portion suppresses the radial movement of the connection terminals. As a result, the electrical connection is further improved, and the structure may be further suitably used as the path for a minute current such as an ionic current or the like.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A high tension connection portion structure of an ignition device for an internal combustion engine, comprising:

a first high tension connection terminal;

a second high tension connection terminal for electrically connecting with said first high tension connection terminal;

a lock structure provided between said first high tension connection terminal and said second high tension connection terminal for restricting the separation therebetween;

a spring member retainer portion formed on an inner wall of said first high tension connection terminal; and a spring member directly connecting said spring member retainer portion of said first high tension connection terminal and said second high tension connection terminal, wherein the spring member retainer portion maintains a constant gap between said first high tension connection terminal and said second high tension connection terminal to enable detection of an ionic current.

2. The high tension connection portion structure of an ignition device for an internal combustion engine, according to claim 1, wherein an end portion of said spring member holds at least one of said first high tension connection terminal and said second high tension connection terminal.

3. The high tension connection portion structure of an ignition device for an internal combustion engine, according to claim 1, wherein said first high tension connection terminal has an outer electrode having a recess type engagement portion into which said second high tension connection terminal is to be inserted, and said spring member is disposed inside of said recess type engagement portion between a closed end of said recess type engagement portion and said second high tension connection terminal.

4. The high tension connection portion structure of an ignition device for an internal combustion engine, according to claim 3, wherein said spring member is enlarged so that a diameter of a part thereof is substantially equal to an inner diameter of the outer electrode.

5. The high tension connection portion structure of an ignition device for an internal combustion engine, according to claim 3, wherein said recess type engagement portion is defined by a cylindrical portion, and said first high tension connection terminal has an insulating retainer portion disposed around an outer circumferential portion of said cylindrical portion.

6. An ignition connection device comprising:

a first high tension connection terminal comprising an outer electrode having a recess portion therein and a spring member retaining portion disposed in said recess portion;

a second high tension connection terminal for electrically connecting with said first high tension connection terminal, said second high tension connection terminal adapted to be received in said recess portion of said outer electrode; and a spring member disposed in said recess portion between said member retaining portion and a conductive end of said second high tension connection terminal, the spring member directly connecting said spring member retainer portion of said first high tension connection terminal and said second high tension connection terminal to maintain a predetermined interval between said spring member retaining portion and said end of said second high tension connection terminal, wherein said spring member retaining portion maintains a constant gap between said first high tension connection terminal and said second high tension connection terminal to enable detection of an ioninc current.

7. The ignition connection device according to claim 6, further comprising a lock structure provided between said first high tension connection terminal and said second high tension connection terminal for restricting separation there between.

8. The ignition connection device according to claim 6, wherein at least a portion of a diameter of said spring member is substantially equal to an inner diameter of said recess portion.

9. The ignition connection device according to claim 6, wherein said first high tension connection terminal further comprises and insulating portion disposed around said outer electrode to suppress radial movement of said first and second high tension connection terminals.

* * * * *